US005953935A

United States Patent [19]

Sorensen

[11] Patent Number: 5,953,935

[45] Date of Patent: Sep. 21, 1999

[54] ETHANE RECOVERY PROCESS

[75] Inventor: James N. Sorensen, Calgary, Canada

[73] Assignee: McDermott Engineers & Constructors (Canada) Ltd., Calgary, Canada

[21] Appl. No.: 08/963,923

[22] Filed: Nov. 4, 1997

[51] Int. Cl.[6] ..... F25J 3/02

[52] U.S. Cl. ..... 62/621; 62/630

[58] Field of Search ..... 62/620, 621, 630

[56] References Cited

U.S. PATENT DOCUMENTS

| | | | |
|---|---|---|---|
| 4,157,904 | 6/1979 | Campbell et al. . | |
| 4,278,457 | 7/1981 | Campbell et al. . | |
| 4,453,958 | 6/1984 | Gulsby et al. | 62/621 |
| 4,519,824 | 5/1985 | Huebel | 62/621 |
| 4,617,039 | 10/1986 | Buck | 62/621 |
| 4,680,042 | 7/1987 | Mehra . | |
| 4,687,499 | 8/1987 | Aghili . | |
| 4,695,303 | 9/1987 | Montgomery, IV et al. . | |
| 4,696,688 | 9/1987 | Mehra . | |
| 4,698,081 | 10/1987 | Aghili . | |
| 4,832,718 | 5/1989 | Mehra . | |
| 4,851,020 | 7/1989 | Montgomery, IV . | |
| 4,854,955 | 8/1989 | Campbell et al. . | |
| 4,869,740 | 9/1989 | Campbell et al. . | |
| 4,883,515 | 11/1989 | Mehra et al. . | |
| 4,889,545 | 12/1989 | Campbell et al. . | |
| 5,275,005 | 1/1994 | Campbell et al. . | |
| 5,325,673 | 7/1994 | Durr et al. . | |
| 5,566,554 | 10/1996 | Vijayaraghavan et al. | 62/621 |
| 5,685,170 | 11/1997 | Sorensen | 62/625 |
| 5,890,377 | 4/1999 | Foglietta | 62/621 |
| 5,890,378 | 4/1999 | Rambo et al. | 62/621 |

FOREIGN PATENT DOCUMENTS

| | | |
|---|---|---|
| 1048397 | 2/1979 | Canada . |
| 1073804 | 3/1980 | Canada . |

*Primary Examiner*—Christopher B. Kilner
*Attorney, Agent, or Firm*—Daniel S. Kalka; Robert J. Edwards

[57] ABSTRACT

An improved ethane recovery system and process which increases the recovery of ethane up to about 99% with no increase in plant residue compression horsepower. The improved ethane recovery process employs an additional fractionation column which receives two vapor streams in different regions thereof which allows the fractionation column to produce the top reflux to the demethanizer column.

13 Claims, 2 Drawing Sheets

ETHANE RECOVERY PROCESS

BACKGROUND OF THE INVENTION

1. Field of the Invention

The present invention relates to a system and a process for recovering ethane and heavier hydrocarbon components from natural gas thereby also generating a gas stream consisting primarily of methane.

2. Description of the Related Art

Many methods currently exist for processing hydrocarbon gas. Some typical examples of isolating and extracting desired components of the higher carbon gas are disclosed in U.S. Pat. Nos. 4,680,042, 4,696,688, 4,832,718 and 4,883,515. These patents generally disclose the removal of a methane rich gas product from an inlet gas stream while also generating a product stream containing ethane, propane, butane, and other heavier hydrocarbon components. The isolation of methane is accomplished by returning a lean solvent from a hydrocarbon product column and injecting the same near the top of an extractor-stripper stripper (ES) column. This lean solvent is used to absorb the heavier hydrocarbon components as a raw gas supplied to the extractor-stripper column. In this fashion the methane rich gas product is removed from the top of the extractor-stripper column.

Additional methods of processing hydrocarbon gas are disclosed in U.S. Pat. Nos. 4,854,955, 4,869,740, 4,889,545, and 5,275,005. These patents all disclose the step of expanding a vapor received from a separator prior to delivering the same to a distillation column.

U.S. Pat. No. 5,325,673 discloses a method of pretreating a natural gas stream using a single scrub column in order to remove freezable $C_5$+ components. This method consist of feeding a natural gas stream to a feed point on a scrub column operated substantially as an absorption column wherein the heavy components are absorbed from the feed gas using a liquid reflux that is essentially free of such $C_5$+ components. This patent also teaches that the reflux stream can be overhead vapor condensate having a temperature of about −40° C., or methane-rich liquified natural gas (LNG) or a combination of LNG and vapor condensate.

U.S. Pat. Nos. 4,157,904, and 4,278,457 relate to hydrocarbon gas processing. These patents are concerned with the recovery of ethane and propane from a gas stream in particular a natural gas stream containing carbon dioxide in excess of 0.02 mole percent.

There is still a need for an ethane recovery process which increases the ethane recovery up to a level of about 99% with no increase in plant residue compression horsepower. Alternatively, an improved process could achieve a 96% ethane recovery with approximately a 10% reduction of residue gas compression horsepower. This can result in significant cost savings.

SUMMARY OF THE INVENTION

The present invention is directed to solving the problems associated with the prior art systems and processes by providing an improved ethane recovery process and system which divides a vapor stream generated from a separator into three streams. One of the streams which is approximately 70% of the vapor stream goes through a turbo expander and enters a demethanizer column in the upper mid-section. The second stream enters the bottom of an additional fractionation column at a reduced pressure to strip methane from the fractionation column bottom product. The third stream which is approximately 20% of the original vapor stream is partially condensed prior to entering the middle of the fractionation column. The additional fractionation column produces the top reflux to the demethanizer column with as high a content of methane as possible. The bottom product from the fractionation column produces ethane and heavier hydrocarbons. The present invention is an improvement over an ethane recovery process such as disclosed in U.S. Pat. No. 4,278,457 in the amount of ethane recovery achieved with no increase in horsepower.

One aspect of the present invention is to provide an improved ethane recovery system.

Another aspect of the present invention is to provide an improved ethane recovery process.

Still another aspect of the present invention is to provide an ethane recovery system which increases ethane recovery to approximately 99% with no increase in plant residue gas compression horsepower.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENTS

Figure 1:
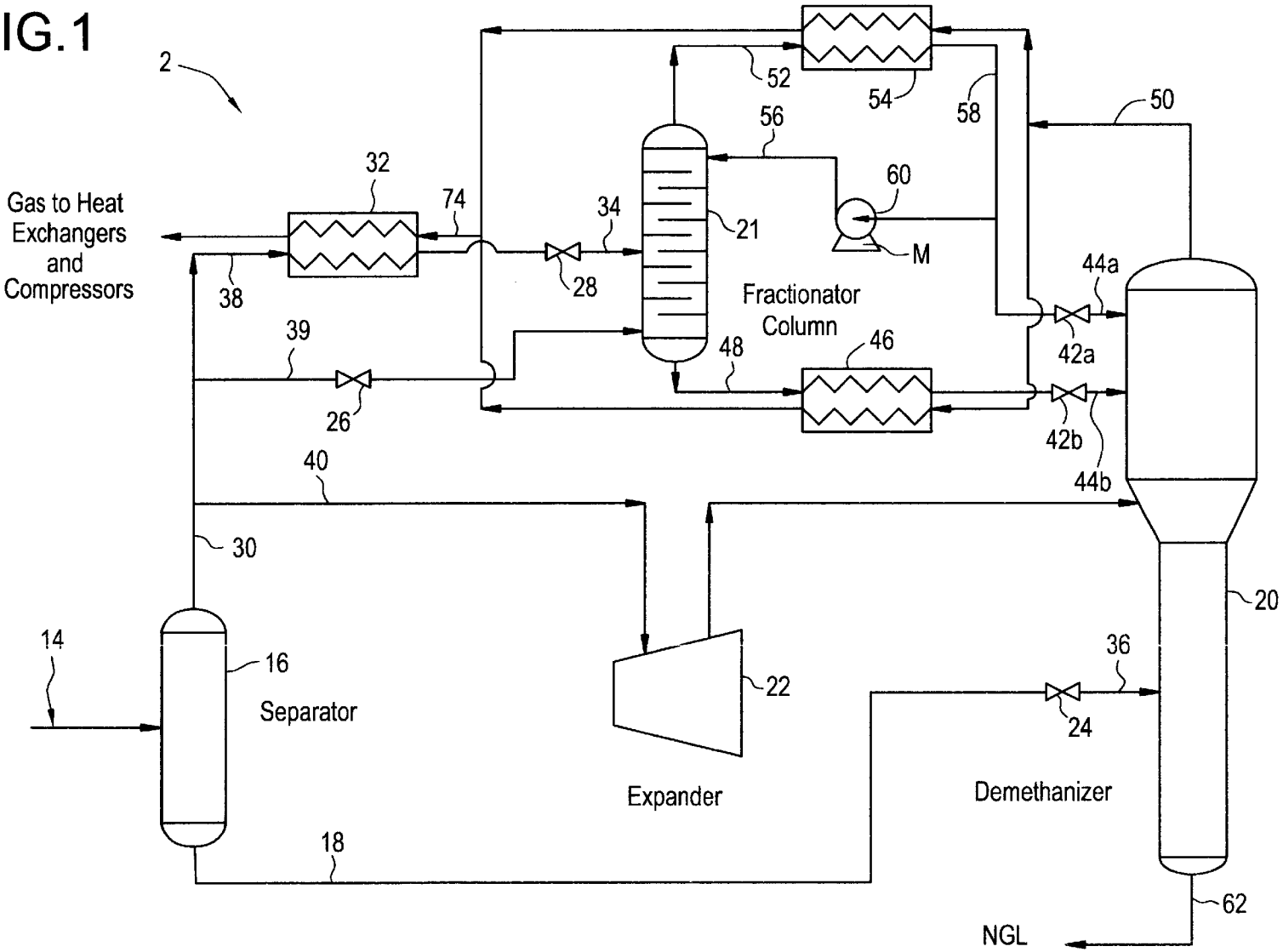
FIG. 1 is a schematic diagram of the ethane recovery system and process according to the present invention.

Referring to the drawings, where like numerals designate like or similar features throughout the several views, and in particular to FIG. 1, there is shown a schematic of the system and process (2) according to the present invention. The cooled natural gas feed stream (14) enters separator (16) where the feed stream is separated into a vapor stream (30) and a liquid stream (18). The liquid stream (18) passes through a valve (24) where its pressure is reduced into a lower pressure liquid stream (36) which enters the central region or mid-column of a distillation column or demethanizer via line (36).

The vapor stream (30) is divided into three streams with suitable dividing means (not shown). The first stream (40) which is approximately 70% on a mole percent basis of vapor stream (30) passes through an expansion means (22) such as a turbo-expander and enters the demethanizer (20) in the upper mid-section region. The second stream (39) which is approximately 10% on a mole percent basis of vapor stream (30) passes through a valve (26) which reduces the pressure of the vapor stream and enters the bottom of a fractionation column (21). This stream (39) strips methane from the fractionation column (21) bottom product in a counter-current manner. The third stream (38) which is approximately 20% on a mole percent basis of vapor stream (30) is partially condensed by cross exchange with cold residue gas (74) in heat exchanger (32) before entering the middle of the fractionation column (21) via line (34). The purpose of fractionation column (21) is to produce the top reflux to the demethanizer (20) with as high a content of methane as possible. The bottom product (48) passes through heat exchanger (46) where it is further cooled and then passes through a valve (42*b*) which reduces the pressure as it enters the demethanizer (20) in the top region thereof through line (44*b*). The fractionation column (21) operates at approximately a pressure of 5000 kpa(ab) to stay inside the liquid/vapor phase envelope. The bottom product stream (48) enters the demethanizer at approximately the fourth tray from the top of the demethanizer. A demethanizer usually employs 10 to 15 number of theoretical stages depending upon the inlet gas (10), process conditions and economic factors. Before entering the demethanizer, stream (48) is cooled by cross exchange with part of the residue gas stream (50) from the top of the demethanizer (20). After it is cooled, stream (48) is let down in pressure. The top product (52) from the fractionation column (21) is completely condensed and subcooled by heat exchanger (54) with a portion of the residue gas stream (50) from the demethanizer (20). The cooled stream (58) is split with suitable means (not shown) into streams (56, 44*a*). Stream (56) is refluxed back to the fractionation column (21) with a reflux pump (60) being provided to increase the head pressure on the stream for delivering it to the top of the fractionation column (21). Stream (44*a*) passes through valve (42*a*) where it is let down in pressure as it enters the top of the demethanizer column (20). The demethanizer column (20) is designed to fractionate methane from ethane and the heavier hydrocarbon components. The residue gas stream (50) being generated from the demethanizer (20) is rich in methane and the concentration of ethane and other heavier hydrocarbon components is significantly reduced. The bottom stream (62) contains all or nearly all of the ethane, propane, butane, and heavier components originally found in the natural gas feed stream (10) and contains relatively small concentrations of methane. This bottom stream (62) is the NGL (natural gas liquids) product in which ethane recovery of approximately 99% on a mole percent basis is achieved with no increase in plant residue gas compression horsepower compared to other systems.

The residue gas stream (50) exiting the top of the demethanizer (20) is divided with one portion passing through the heat exchanger (54) and the other portion passing through heat exchanger (46). The residue gas stream (50) is then later recombined in stream (74) to pass through heat exchanger (32) and then passes through heat exchangers (not shown) . After the residue gas stream (74) is warmed in this manner, it passes through compressor (not shown) which increase its pressure and results in a residue gas stream consisting predominantly of methane and only token quantities of ethane or other heavier hydrocarbon.

The improved ethane recovery process according to the present invention increases ethane recovery from 96.0% to approximately 99% with no increase in plant residue compression horsepower.

Figure 2:
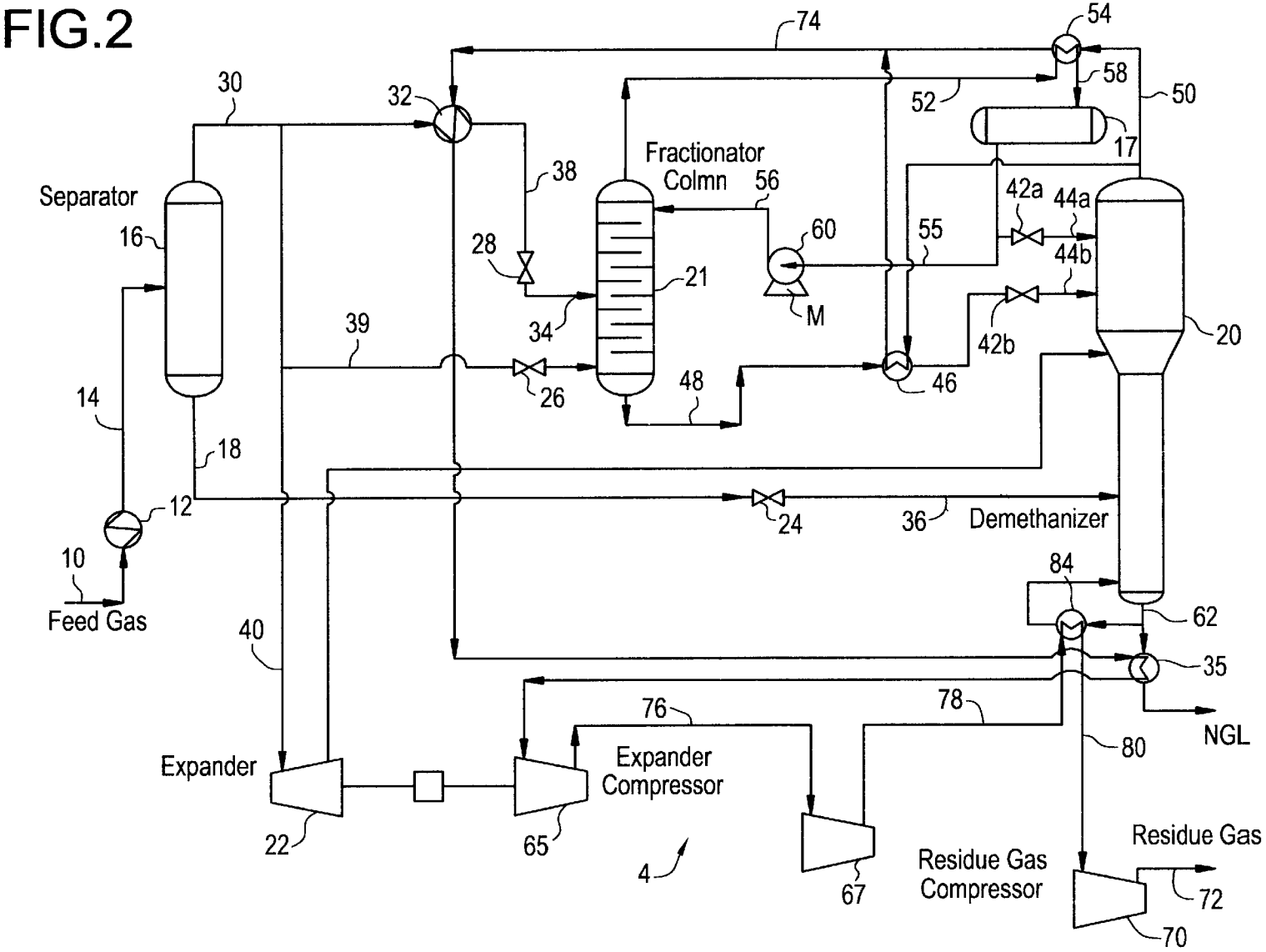
FIG. 2 is a schematic diagram of one embodiment of the process according to the present invention.

Turning next to FIG. 2, there is shown an embodiment of the system and process according to the present invention. This system generally depicted as (4) is very similar to system (2) shown in FIG. 1. Natural gas feed (10) is cooled in a heat exchanger (12) in a cross exchange manner with streams generated from the process. System (4) operates in the manner previously described with respect to system (2) as like numerals designate like features in achieving similar results. The residue gas stream (74) then passes through still yet another heat exchanger (35) to cool the bottom stream (62), which results in subcooling the NGL for refrigerated storage. The residue gas stream (74) after it passes through heat exchanger (35) enters the compressor side (65) of the expander/compressor (22), (65) where it is then supplied to the residue gas compressor which may comprise one or more stages (67) (70). The first stage discharge stream (78) passes to a reboiler (84) which provides heat to the demethanizer column. The cooled residue gas stream (80) passes to compressor (70) where it is compressed and exits as a residue gas (72).

A typical example of the process (4) would be as follows with the specified temperatures (° C.) and pressures (kPa) (ab) which means kilopascal absolute. The natural gas feed stream (10) enters a heat exchanger (12) at a temperature of approximately −12° C. and an approximate pressure of 6490 kPa. As the cooled feed stream exits the heat exchanger (12) it is at a temperature of −29° C. and an approximate pressure of 6405 kPa. The feed gas stream is separated into a vapor stream (30) and a liquid stream (18). The liquid stream (18) is at a temperature of −29° C. and an approximate pressure of 6405 kPa. After the liquid stream (18) passes through valve (24), its pressure is reduced to approximately 1490 kPa. The vapor stream (30) splits into three streams (38), (39), (40) with the first vapor stream (40) entering the expansion device (22) at a temperature of approximately −29° C. Once the first vapor stream passes through the expansion means (22) it has an approximate temperature of −84.38° C. and an approximate pressure of 1480 kPa. The second portion (39) of vapor stream (30) passes through valve (26) where its pressure is reduced from 6405 kPa to about 5055 kPa and a temperature of about −37.2° C. The third portion (38) of the vapor stream (30) passes through heat exchanger (32) where it is cooled to a temperature of about −69.5° C. and valve (28) reduces its pressure to about 5015 kPa. In the fractionation column (21), the bottom liquid stream (48) is at a pressure of about 5050 kPa and a temperature of −62.63° C. The temperature of this liquids portion is further reduced to −94.470° C. once it passes through heat exchanger (46) and its pressure is further reduced after passing through valve (42*b*) to about 1470 kPa as it enters the demethanizer (20). The top portion (52) exits the fractionation column (21) at a pressure of about 5010 kPa and a temperature of −75.76° C. Stream (52) is further cooled in heat exchanger (54) to a temperature of −113.56° C. and a pressure of about 4966 kPa. One portion (56) of stream (58) is pumped back into the top region of the fractionation column (21) while the other portion is sent via line (44*a*) to the top of the demethanizer (20) at a reduced pressure of about 1452 kPa after passing through valve (42*a*). The residue gas stream (50) exits the top of the demethanizer (20) at a temperature of about −115.18° C. and a pressure of about 1452 kPa. The residue gas stream (50) is divided into one portion that passes through heat exchanger (54) and the other portion passing through heat exchanger (46) where they eventually recombine in a combiner (not shown) with a pressure of about 1417 kPa and a temperature of about −74.8° C. The residue gas stream (74) then passes through heat exchangers (32) and (35) and enters compressor (65) at a temperature of about −38.93° C. and a pressure of 1347 kPa. After passing through the first stage residue gas compressor (67), the residue gas stream is at a temperature of about 31.35° C. and a pressure of about 3034 kPa. The residue gas stream (80) enters the second stage residue gas compressor (70) at a pressure of about 2965 kPa and a temperature of about −9.22° C. The compressor (70) increases the pressure up to about 6677 kPa and a temperature of about 66.34° C. for the residue gas (72) which consists primarily of methane with relatively low if insignificant quantities of ethane, propane, butane and the like. The bottom portion (62) exiting the demethanizer (20) is at a pressure of about 1492 kPa and a temperature of −12.06° C. Heat exchanger (35) further cools the bottom NGL to a temperature of about −24° C. and a pressure of about 1457 kPa.

While specific embodiments of the invention have been shown and described in detail to illustrate the application and principles of the invention, certain modifications and improvements will occur to those skilled in the art upon reading the foregoing description. It is thus understood that such modifications and improvements have been deleted herein for the sake of conciseness and readability but are properly within the scope of the following claims.

I claim:

1. In an ethane recovery system, an apparatus comprising:

separating means constructed to receive a cooled natural feed gas stream, said separating means dividing the cooled natural feed gas stream into an upper vapor stream and a lower liquid stream;

dividing means connected to said separating means and receiving said upper vapor stream therefrom, said dividing means dividing the vapor stream into three streams, a first, a second, and a third vapor streams;

distilling means located downstream from said separating means and said dividing means, said distilling means providing a bottom ethane product stream and an upper methane residue gas stream, said distilling means being connected to said separating means and receiving said lower liquid stream in a middle region of said distilling means, said distilling means further receiving said first vapor stream from said separating means in an upper mid-section region thereof;

fractionating means connected to said separating means and to said distilling means , said fractionating means receiving said second and third vapor streams for separating methane therefrom and providing a bottom stream as a top reflux to said distilling means.

2. In an ethane recovery system as set forth in claim 1, wherein said second vapor stream enters said fractionating means in a bottom region.

3. In an ethane recovery system as set forth in claim 2, wherein said third vapor stream enters said fractionating means in a middle region of said fractionating means.

4. In an ethane recovery system as set forth in claim 3, the apparatus further comprising a heat exchanger connected to said separating means for cooling said third vapor stream prior to said fractionating means.

5. In an ethane recovery system as set forth in claim 1, the apparatus further comprising compression means located downstream from said distilling means for compressing the upper methane residue gas stream.

6. In an ethane recovery system as set forth in claim 1, wherein said distilling means comprises a demethanizer.

7. In an ethane recovery system as set forth in claim 1, wherein said fractionating means comprises an absorber.

8. In an ethane recovery system as set forth in claim 1, the apparatus further comprising a heat exchanger for cooling said natural gas feed stream and warming the upper methane residue gas stream.

9. In an ethane recovery system as set forth in claim 8, the apparatus further comprising a plurality of heat exchangers for warming the upper methane residue gas stream.

10. In an ethane recovery process, the method comprising the steps of:

locating a separator downstream from a heat exchanger for receiving a cooled natural feed gas stream;

separating the cooled natural feed gas stream into an upper vapor stream and a lower liquid stream;

dividing the upper vapor stream into a first, a second, and a third vapor streams;

delivering the lower liquid stream from the separator to a middle region of a demethanizer;

passing the first vapor stream through an expander and into an upper mid-section of the demethanizer;

passing the second vapor stream into a bottom region of fractionating means;

passing the third vapor stream into a middle region of the fractionating means;

sending a bottom stream from the fractionating means to an upper region of the demethanizer; and producing an upper methane residue gas stream and a lower bottom natural gas liquids stream with the demethanizer.

11. In an ethane recovery process as set forth in claim 10, the method further comprising the step of passing a portion of the upper methane residue gas stream into the fractionating means.

12. In an ethane recovery process as set forth in claim 11, the method further comprising the steps of producing a bottom stream with the fractionating means and sending it to an upper region of the demethanizer.

13. In an ethane recovery process as set forth in claim 1, wherein the overhead gas stream from the fractionating means is condensed and partly recycled to the top region of the fractionating means.

* * * * *